US007631635B2

(12) United States Patent
Hochstein et al.

(10) Patent No.: US 7,631,635 B2
(45) Date of Patent: Dec. 15, 2009

(54) LIQUID SEPARATOR AND VENTED FUEL TANK ARRANGEMENT

(75) Inventors: Andrej Hochstein, Karlsruhe (DE); Martin Stickel, Muggensturm (DE)

(73) Assignee: TI Automotive Technology Center GmbH, Rastatt (DE)

( * ) Notice: Subject to any disclaimer, the term of this patent is extended or adjusted under 35 U.S.C. 154(b) by 0 days.

(21) Appl. No.: 12/113,383

(22) Filed: May 1, 2008

(65) Prior Publication Data

US 2008/0295809 A1 Dec. 4, 2008

Related U.S. Application Data

(60) Provisional application No. 60/941,532, filed on Jun. 1, 2007.

(51) Int. Cl.
*F02M 37/20* (2006.01)
*F02M 33/02* (2006.01)

(52) U.S. Cl. ..... 123/516; 123/518

(58) Field of Classification Search ..... 123/516, 123/518–519; 137/565.34
See application file for complete search history.

(56) References Cited

U.S. PATENT DOCUMENTS 3,687,335 A * 8/1972 Hunter ..... 220/746
3,752,135 A * 8/1973 Peterson et al. ..... 123/519
3,771,690 A * 11/1973 Hunter ..... 220/746
3,910,302 A * 10/1975 Sudhir ..... 137/43
3,917,109 A * 11/1975 MacDonald ..... 220/746
4,714,171 A * 12/1987 Sasaki et al. ..... 220/746
4,809,666 A * 3/1989 Baltz ..... 123/516
4,836,402 A * 6/1989 Sasaki ..... 220/746
5,343,905 A * 9/1994 Gryc et al. ..... 141/59
5,372,116 A * 12/1994 Davis ..... 123/516
5,868,119 A 2/1999 Endo et al.
5,950,688 A * 9/1999 Langlois ..... 141/1
6,253,742 B1 * 7/2001 Wickman et al. ..... 123/516
6,553,974 B1 * 4/2003 Wickman et al. ..... 123/516
6,591,866 B2 7/2003 Distelhoff et al.
6,964,268 B2 11/2005 Stickel
7,178,512 B1 * 2/2007 Merten ..... 123/516

* cited by examiner

*Primary Examiner*—Thomas N Moulis
(74) *Attorney, Agent, or Firm*—Reising Ethington P.C.

(57) ABSTRACT

A fuel system includes a fuel tank and a liquid separator. The fuel tank includes an interior in which liquid fuel and fuel vapor are contained, and has at least one vent in fluid communication with a vapor dome in the interior of the fuel tank. The liquid separator is in fluid communication with the at least one vent in the fuel tank, and has a fuel port disposed at a lower elevation than the at least one vent to enable the liquid separator to be passively aspirated under negative pressure conditions within the fuel tank. The liquid separator may be placed inside or outside the fuel tank.

9 Claims, 1 Drawing Sheet

LIQUID SEPARATOR AND VENTED FUEL TANK ARRANGEMENT

CROSS-REFERENCE TO RELATED APPLICATIONS

This application claims the benefit of U.S. Provisional Application Ser. No. 60/941,532 filed Jun. 1, 2007.

The content of the above application is incorporated herein by reference in its entirety.

FIELD OF THE INVENTION

The present invention relates generally to a fuel system for combustion engines, and more particularly to an arrangement of a liquid separator and a fuel tank.

BACKGROUND OF THE INVENTION

Vehicle fuel tanks for volatile hydrocarbon fuels such as gasoline normally contain a volume of liquid fuel and a volume of gas above the liquid fuel. Ambient temperature fluctuations lead to corresponding pressure fluctuations in the fuel tank. Excess pressure buildup in the fuel tank is reduced by a fuel tank venting system that vents fuel vapor out of a vent outlet of the fuel tank, collects and stores the fuel vapor in an activated carbon canister (ACC), and releases the fuel vapor downstream to an operating engine for combustion in the engine.

A liquid separator is placed in fluid communication between the fuel tank and the ACC to prevent carryover of a portion of the liquid fuel from the fuel tank to the ACC. Accordingly, the liquid separator separates and contains some liquid fuel and allows gaseous fuel vapor to pass to the ACC. But, from time to time, the liquid fuel must be transferred from the liquid separator back to the liquid fuel volume of the fuel tank to prevent the liquid separator from filling and blocking flow of gaseous fuel vapor therethrough.

There are three conventional solutions to this problem. First, the liquid separator may be located within the fuel tank and a fuel pump or a jet pump in the fuel tank may be placed in fluid communication with the liquid separator to discharge liquid fuel out of the liquid separator and into the liquid fuel volume of the fuel tank. Second, the liquid separator may be placed in an upper gaseous portion of the fuel tank interior and may include a bottom wall sloped toward a drain opening to discharge liquid fuel by gravity. Third, the liquid separator may be placed above the fuel tank such that a drain port of the liquid separator is higher than the vapor outlet of the fuel tank so that the liquid separator drains liquid fuel to the fuel tank under the force of gravity.

SUMMARY OF THE INVENTION

A fuel system according to one implementation includes a fuel tank and a liquid separator. The fuel tank includes an interior in which liquid fuel and fuel vapor are contained, and has at least one vent in fluid communication with a vapor dome in the interior of the fuel tank. The liquid separator is in fluid communication with the at least one vent in the fuel tank, and has a fuel port disposed at a lower elevation than the at least one vent to enable the liquid fuel in the liquid separator to be passively aspirated under negative pressure conditions within the fuel tank.

A method according to one implementation includes emptying a liquid separator. The method includes providing a fuel tank having a vent opening, and providing the liquid separator with a fuel port. The method also includes disposing the liquid separator at an elevation with respect to the fuel tank such that the fuel port is disposed at a lower elevation than the vent opening of the fuel tank to enable the liquid fuel in the liquid separator to be passively aspirated under negative pressure conditions within the fuel tank.

At least some of the objects, features and advantages that may be achieved by at least certain embodiments of the invention include providing a fuel system that does not require a fuel pump or jet to drain liquid fuel from a liquid separator; does not require mounting a liquid separator within an upper interior portion of a fuel tank or above a fuel tank; enables a liquid separator to be mounted inside or outside a fuel tank and to be aspirated under negative pressure conditions within the fuel tank; is of relatively simple design, economical manufacture and assembly, rugged, durable, reliable, and in service has a long useful life.

Of course, other objects, features and advantages will be apparent in view of this disclosure to those skilled in the art. Various other fuel systems embodying the invention may achieve more or less than the noted objects, features or advantages.

BRIEF DESCRIPTION OF THE DRAWINGS

These and other objects, features and advantages of the present invention will be apparent from the following detailed description of preferred embodiments and best mode, appended claims, and accompanying drawings in which:

DETAILED DESCRIPTION OF PREFERRED EMBODIMENTS

Figure 1:
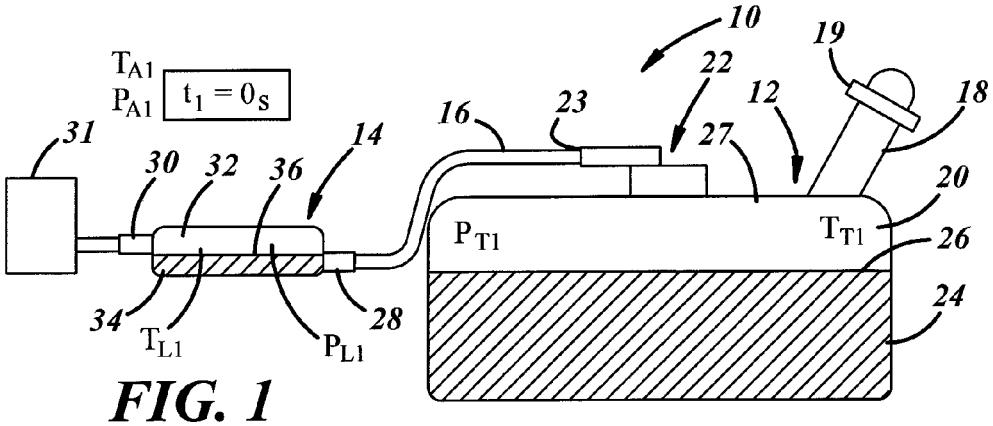
FIG. 1 is a schematic view of a presently preferred form of a fuel system including a fuel tank and a liquid separator.

Referring in more detail to the drawings, FIG. 1 illustrates an exemplary fuel system 10 for containing, venting, and separating fuel vapor and liquid fuel of a volatile hydrocarbon fuel such as gasoline for the engine of an automotive vehicle. The fuel system 10 includes a fuel tank 12 to contain and vent fuel, and a liquid separator 14 to separate liquid fuel from gaseous fuel vapor. The fuel system 10 may also include a fuel conduit 16 in fluid communication between the liquid separator 14 and the fuel tank 12. The fuel conduit 16 may include any suitable device(s) such as one or more hoses, pipes, tubes, or integral passages between the liquid separator 14 or fuel tank 12. An exemplary size of the fuel conduit 16 is on the order of about 8 mm in diameter.

The fuel tank 12 may include a fuel filler pipe 18, with a removable closure or cap 19, to admit fuel into an interior 20 of the fuel tank 12, and a vent 22 to permit fuel vapor to be vented out of the interior 20 of the fuel tank 12. The vent 22 may include an opening in a wall of the fuel tank 12, a one-way or two-way check valve in fluid communication with such an opening, or a rollover vent valve in communication with such an opening. In other words, the vent 22 may be any suitable fluid communication feature or device, and includes a vent opening 23. The fuel tank 12 holds liquid fuel 24, which may accumulate up to a predetermined maximum level 26, with a vapor dome 27 above the liquid fuel in the interior of the fuel tank 12. The vapor dome 27 may include a dome-shaped geometric feature but may also include the variable volume gaseous space above the liquid fuel 24. The vent 22 and its vent opening 23 are in fluid communication with the vapor dome 27 and with the conduit 16. An exemplary size of the fuel tank 12 is on the order of about ninety liters.

The liquid separator 14 includes one or more fuel ports 28 to receive incoming fuel vapor and transmit outgoing liquid fuel, and may also include one or more gaseous fuel vapor outlets 30 to transmit outgoing gaseous fuel vapor to a downstream device such as canister 31 with activated carbon. The fuel port(s) 28 may be located at or near a lowermost portion of the liquid separator 14, and the vapor outlet(s) 30 may be located at or near an uppermost portion of the liquid separator 14. The liquid separator 14 defines an interior 32, in which liquid fuel 34 may accumulate up to a predetermined maximum level 36. An exemplary size of the liquid separator 14 is on the order of about 500 ml, with a useable volume on the order of about 250 ml.

In general, the liquid separator 14 may be disposed inside or outside of the fuel tank 12. More specifically, whether disposed inside or outside of the fuel tank 12, the liquid separator 14 is disposed at an elevation with respect to the fuel tank 12 such that the fuel port 28 is disposed at a lower elevation than the vent opening 23 of the fuel tank 12. Even more specifically, the liquid separator 14 may be disposed at an elevation with respect to the fuel tank 12 such that the surface of liquid fuel at its maximum level in the liquid separator 14 is disposed at a lower elevation than the vent opening 23 of the vent 22 in the fuel tank 12. Also, the gaseous fuel vapor outlet 30 may be disposed at a higher elevation than the fuel port 28, and is preferably disposed as high as possible for better liquid vapor separation. Also, for example, the fuel port 28 may be disposed within about 5 to 400 mm lower than the vent 22. Furthermore, the fuel port 28 may be disposed at a higher elevation than the maximum liquid fuel level 26 in the fuel tank 12. In an exemplary fuel system, for every 1 mm in height differential between the fuel port 28 and the vent opening 23, about 0.01 kPa in negative fuel tank pressure may be required to aspirate liquid fuel from the liquid separator 14 to the fuel tank 12.

In use, some portion of the liquid fuel 24 in the fuel tank 12 is converted to fuel vapor, which is vented (along with any liquid fuel) through the opening 23 of the vent 22, through the conduit 16, and into the liquid separator 14. Thereafter, some portion of the liquid fuel is separated from the vented fuel vapor and retained in the liquid separator 14 and the fuel vapor is communicated to some useful downstream device such as an ACC and/or an operating engine. According to three exemplary conditions, when pressure in the fuel tank 12 is negative, liquid fuel 34 in the liquid separator 14 is passively aspirated out of the fuel port 28, through the conduit 16, through the opening 23 of the vent 22, and back into the fuel tank 12. Such conditions are discussed below in turn with reference to FIGS. 1 through 3. But first, another fuel system is presented below.

Figure 3:
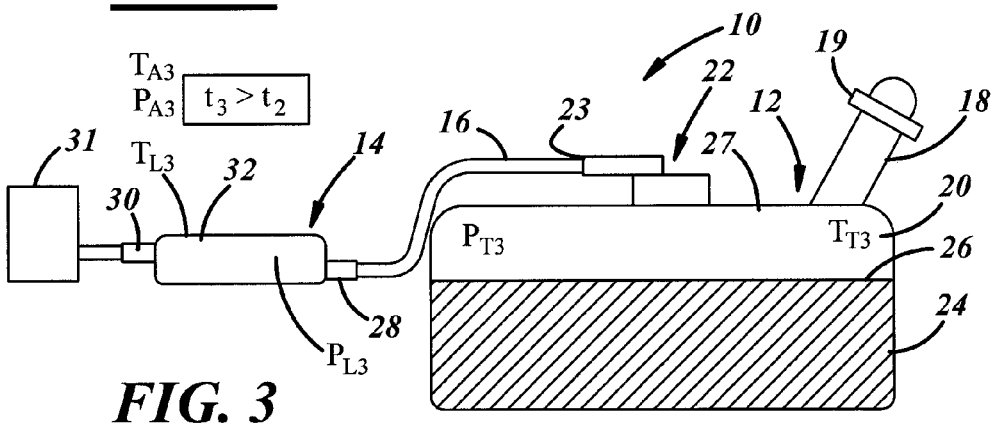
FIG. 3 is a schematic view of the fuel system of FIG. 1 in an end state of draining of the liquid separator.
Figure 4:
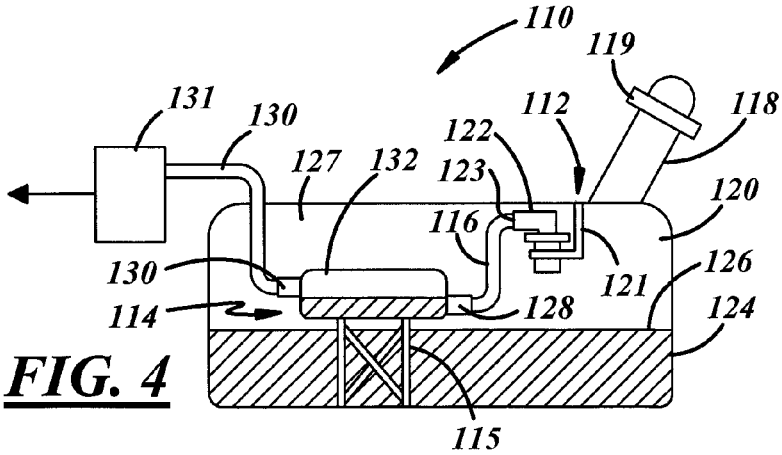
FIG. 4 is a schematic view of another presently preferred form of a fuel system including a fuel tank and a liquid separator.

FIG. 4 illustrates another presently preferred form of a fuel system 110. This form is similar in many respects to the form of FIGS. 1 through 3, and like numerals between the forms generally designate like or corresponding elements throughout the several views of the drawing figures. Accordingly, the description of the fuel system 10 is incorporated into the following description of the fuel system 110 by reference in its entirety. Additionally, the description of the common subject matter generally may not be repeated here.

In FIG. 4, the fuel system 110 includes a vent 122 and a liquid separator 114 disposed within an interior 120 of a fuel tank 112. The vent 122 may be carried in the fuel tank 112 in any suitable manner, for example, using any suitable bracket 121 that may be mounted to the fuel tank 112 and adapted to carry the vent 122. According to one alternative, the vent 122 could be mounted directly to a wall of the fuel tank 112 without the bracket 121. Similarly, the liquid separator 114 is carried in the fuel tank 112 in any suitable manner, for example, using any suitable support 115 that may be mounted to the fuel tank 112 and adapted to carry the liquid separator 114. According to an alternative, the liquid separator 114 could rest on the bottom of the fuel tank 112 or could be mounted directly thereto without the support 115.

In any case, the liquid separator 114 may be disposed at an elevation with respect to the fuel tank 112 such that its fuel port 128 is disposed at a lower elevation than a vent opening 123 of the fuel tank 112. Even more specifically, the liquid separator 114 may be disposed at an elevation with respect to the fuel tank 112 such that the surface of liquid fuel at its maximum level in the liquid separator 114 is disposed at a lower elevation than the vent opening 123 of the vent 122 in the fuel tank 112. Furthermore, the fuel port 128 may be disposed at a higher elevation than a maximum liquid fuel level 126 in the fuel tank 112.

One of the conditions occurs when a vehicle is driven downhill, wherein atmospheric pressure increases, thereby creating a relative pressure decrease in a fuel tank. For example, when a vehicle drives from about 2500 meters above sea level to about 500 meters above sea level, atmospheric pressure increases from about 750 mbar (75 kPa) to about 950 mbar (95 kPa). In other words, such vehicle descent results in a pressure increase of about 20 kPa over 2000 meters of descent, or about 0.01 kPa/meter. Again, for every 1 millimeter (mm) in vertical height differential between the surface of liquid fuel at its maximum level in the exemplary liquid separator and the fuel tank vent opening, about 0.01 kPa in negative fuel tank pressure may be required to aspirate liquid fuel from an exemplary liquid separator into its fuel tank. Thus, for a 10 mm height differential, a 10 m vehicle descent is required to aspirate fuel from the exemplary liquid separator into the fuel tank.

Another condition occurs when fuel tank temperature decreases, such as after a vehicle is stopped, shut down, and parked for an extended period. An exemplary reduction in fuel tank temperature ranges from about 40° C. to about 28° C. The ideal gas law may be simplified to $P \times V/T$=constant, wherein P is gas pressure in a vessel, V is gas volume of the vessel, and T is gas temperature ° K in the vessel. Accordingly, $P_1 \times V_1/T_1 = P_2 \times V_2/T_2$, wherein $V_2 = V_1 + \Delta V$. For a fuel volume $\Delta V = \alpha_v \times V_{fuel} \times \Delta T$, a volume expansion factor for a typical automotive gasoline $\alpha_v = 0.0011\ K^{-1}$.

An exemplary test involved a height differential of about 25 mm between a surface of liquid fuel at its maximum level in a liquid separator and a fuel tank vent opening. At this height differential, a negative pressure of about 0.25 kPA is required to aspirate the liquid separator. According to the exemplary test, an initial tank pressure $P_1$ was about 107 kPa, the initial vapor volume $V_1$ was about 80 liters (l) and initial liquid fuel volume was about 10 l of a total fuel tank volume of about 90 l, and an initial temperature $T_1$ of about 39° C. (312 K) was noted. After about 6.5 minutes of vehicle shut down, liquid fuel began flowing from the liquid separator into the fuel tank and an interim temperature $T_2$ of about 37° C. (310 K) was noted.

From the equations described above, $\Delta V = 0.0011\ K^{-1}$ (10 l×2 K)=0.022 l and, thus, an interim volume $V_2$=80 l+0.022 l 80.02 l. Therefore, an interim pressure $P_2=(P_1\times V_1/T_1)/(V_2/T_2)=(107\text{ kPa}\times 80\text{ l}/312\text{ K})/(80.02\text{ l}/310\text{ K})=106.3$ kPA. The pressure dr about 0.7 kPa between initial and interim pressures $P_1$ and $P_2$ exceeds the 0.25 kPa needed and, thus, aspiration of the liquid separator began. After about 18 minutes, all liquid fuel was aspirated out of the liquid separator and pressure in the fuel tank and liquid separator equalized, such that an end pressure $P_3$ was zero.

A further condition occurs when a vehicle is initially started after the vehicle has been shut down for an extended period. Because the temperature is basically constant, under the simplified ideal gas law, $P\times V=\text{constant}$, so that $P_1\times V_1=P_2\times V_2$. Thus, $P_2=P_1\times V_1/V_2$ for the gas volume in a fuel tank. $V_2=V_1+V_{FC}$ (volume of fuel pumped out of the fuel tank for consumption by the engine).

Parameter values during one exemplary test include 1 liter per hour (lph) fuel consumption, initial gas pressure $P_1$ of about 1 bar atmospheric pressure, and initial gas volume $V_1$ of about 20 l. Under these conditions, about 1.2 minutes after vehicle startup, fuel began flowing from the liquid separator to the fuel tank. Accordingly, an interim gas volume $V_2=20\text{ l}+(1\text{ lph}\times 1.2/60\text{ h})=20.02$ l. Thus, interim gas pressure $P_2=1\text{ bar}\times 20\text{ l}/20.02\text{ l}=0.99$ bar. Thus, the pressure drop in the fuel tank at the start of aspiration was about 0.01 bar or 1 kPa. The 100 ml of fuel in the liquid separator is aspirated at the rate of the fuel consumption of 1 lph. Accordingly, the period over which the liquid separator is aspirated can be calculated as follows: (1000 ml/60 min)/100 ml=6 minutes. Therefore, the liquid separator is aspirated within about 7.2 minutes after vehicle startup in this example.

FIG. 1 illustrates an initial situation at time $t_1$ wherein some portion of the interior volume of the liquid separator contains liquid fuel. According to the first and third exemplary conditions described above, initial pressure within the fuel tank $P_{T1}$ is substantially equal to initial pressure within the liquid separator $P_{L1}$, and initial fuel tank and separator pressures $P_{T1}$, $P_{L1}$ are substantially equal to or somewhat greater than initial atmospheric pressure $P_{A1}$. According to the second exemplary condition, the initial temperature in the fuel tank $T_{T1}$ is substantially equal to the initial liquid separator temperature $T_{L1}$, both of which are greater than the initial atmospheric temperature $T_{A1}$. According to the third exemplary condition, the initial tank temperature $T_{T1}$ is substantially equal to initial separator and atmospheric temperatures $T_{L1}$ and $T_{A1}$, and engine fuel consumption is 0 lph. Under these conditions, no aspiration of liquid fuel from the liquid separator occurs.

Figure 2:
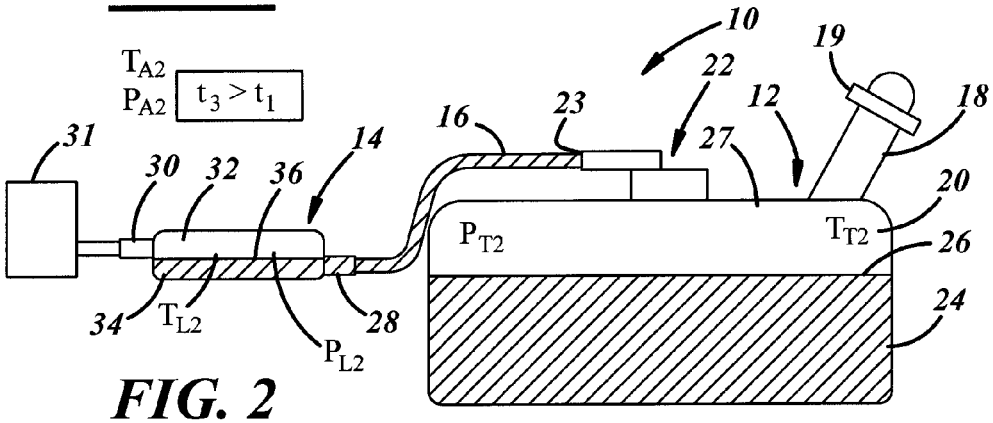
FIG. 2 is a schematic view of the fuel system of FIG. 1 in an initial state of draining of the liquid separator.

FIG. 2 illustrates a start of aspiration of liquid fuel from the liquid separator at an interim time $t_2$ after the initial time $t_1$. According to the first exemplary condition, an interim atmospheric pressure $P_{A2}$ is elevated with respect to initial atmospheric pressure $P_{A1}$, and $P_{A2}$ is greater than an interim tank pressure $P_{T2}$, which is substantially the same as the initial tank pressure $P_{T1}$. According to the second exemplary condition, initial atmospheric temperature $T_{A1}$ is substantially equal to an interim atmospheric temperature $T_{A2}$, but an interim tank temperature $T_{T2}$ is lower than initial tank temperature $T_{T1}$ and an interim tank pressure $P_{T2}$ is lower than initial tank pressure $P_{T1}$. According to the third exemplary condition, the interim tank pressure $P_{T2}$ is lower than initial tank pressure $P_{T1}$ because engine fuel consumption is greater than 0 lph, thereby creating a negative pressure in the fuel tank that aspirates liquid fuel from the liquid separator.

FIG. 3 illustrates an end aspiration of the liquid separator at an end time $t_3$ after the interim time $t_2$. According to the first exemplary condition, an end atmospheric pressure $P_{A3}$ is greater than the interim atmospheric pressure $P_{A2}$ but is equal to initial tank and separator pressure $P_{T1}$ and $P_{L1}$, which have both equalized to the end atmospheric pressure $P_{A3}$ because the liquid separator is now empty of liquid fuel. Once $P_{T1}=P_{L1}$ by removing liquid fuel from the separator, the temperature is irrelevant. According to the second exemplary condition, an end atmospheric temperature $T_{A3}$ is lower than or equal to an end tank temperature $T_{T3}$, which is substantially equal to an end liquid separator temperature $T_{L3}$. Also, pressures of the fuel tank, liquid separator, and atmosphere have stabilized and are substantially equal. Similarly, and according to the third exemplary condition, engine fuel consumption is greater than 0 lph and has effectively drained the liquid separator, thereby resulting in stabilized and substantially equal pressures in the separator and tank.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A fuel system, comprising:

a fuel tank having an interior in which liquid fuel and fuel vapor are contained, and having at least one fuel vapor vent in fluid communication with a vapor dome in the interior of the fuel tank; and a liquid separator having a fuel vapor outlet and a separate fuel port in fluid communication with the at least one fuel vapor vent in the fuel tank, and the fuel port is disposed at a lower elevation than the at least one fuel vapor vent to enable liquid fuel in the liquid separator to be passively aspirated from the liquid separator through the fuel port and fuel vapor vent into the fuel tank under negative pressure conditions within the fuel tank.

2. The fuel system of claim 1 wherein the fuel port is disposed within about 5 to 400 mm lower than the at least one fuel vapor vent.

3. The fuel system of claim 1 wherein the fuel port is disposed at a higher elevation than a maximum liquid fuel level in the fuel tank.

4. The fuel system of claim 1 wherein the liquid separator is disposed outside of the fuel tank.

5. The fuel system of claim 1 wherein the liquid separator is disposed inside of the fuel tank.

6. A method of emptying a liquid separator, comprising:

providing a fuel tank having a vent opening communicating with a vapor dome in the fuel tank;

providing the liquid separator with a fuel vapor port and a separate fuel port in fluid communication with the vent opening; and disposing the liquid separator at an elevation with respect to the fuel tank such that the fuel port is disposed at a lower elevation than the vent opening of the fuel tank to enable liquid fuel in the liquid separator to be passively aspirated from the separator through the fuel port and vent opening under negative pressure conditions within the fuel tank.

7. The method of claim 6 wherein the liquid separator is disposed at an elevation with respect to the fuel tank such that a surface of liquid fuel at its maximum level within the liquid separator is disposed at a lower elevation than the vent opening of the fuel tank.

8. The method of claim 6 wherein the liquid separator is disposed outside of the fuel tank.

9. The method of claim 6 wherein the liquid separator is disposed inside of the fuel tank.

* * * * *